US007360578B2

(12) United States Patent
Tseng

(10) Patent No.: US 7,360,578 B2
(45) Date of Patent: Apr. 22, 2008

(54) METHOD OF JOINING WAX PATTERNS FOR FABRICATING GOLF CLUB HEAD

(75) Inventor: Chieh-Fu Tseng, Kaohsiung (TW)

(73) Assignee: Advanced International Multitech Co., Ltd., Kaohsiung (TW)

( * ) Notice: Subject to any disclaimer, the term of this patent is extended or adjusted under 35 U.S.C. 154(b) by 0 days.

(21) Appl. No.: 11/503,948

(22) Filed: Aug. 15, 2006

(65) Prior Publication Data

US 2008/0000605 A1 Jan. 3, 2008

(30) Foreign Application Priority Data

Jun. 30, 2006 (TW) ..... 95124040 A

(51) Int. Cl.
*B22C 7/02* (2006.01)
*B22C 9/04* (2006.01)

(52) U.S. Cl. ..... 164/35; 164/45

(58) Field of Classification Search ..... 164/34–36, 164/45

See application file for complete search history.

(56) References Cited

U.S. PATENT DOCUMENTS

| | | | | |
|---|---|---|---|---|
| 5,086,825 | A * | 2/1992 | VanRens et al. | 164/4.1 |
| 6,739,376 | B1 | 5/2004 | Cheng et al. | |
| 6,971,436 | B2 | 12/2005 | Huang | |
| 2005/0034834 | A1 | 2/2005 | Huang | |
| 2005/0224207 | A1 | 10/2005 | Huang | |

* cited by examiner

*Primary Examiner*—Kuang Lin
(74) *Attorney, Agent, or Firm*—Morris Manning Martin LLP; Tim Tingkang Xia, Esq.

(57) ABSTRACT

In one aspect, the present invention relates to a method of joining wax patterns for fabricating a golf club head. In one embodiment, the method has the step of providing a pre-fabricated first wax pattern and a prefabricated second wax pattern, embedding a joining portion of the second wax pattern into a recess portion of the first wax pattern, heating a flange formed on the recess portion to make the flange soften, and using a flattening tool to fold the flange over and into a chambered receiving portion on the second wax pattern such that the first wax pattern and second wax pattern are melted into a whole, joined surfaces of the first wax pattern and the second wax pattern are joined tightly with no gaps, and a single wax pattern if formed.

8 Claims, 4 Drawing Sheets

METHOD OF JOINING WAX PATTERNS FOR FABRICATING GOLF CLUB HEAD

CROSS-REFERENCE TO RELATED APPLICATIONS

This non-provisional application claims priority under 35 U.S.C. §119(a) to Patent Application No. 095124040 filed on Taiwan, R.O.C. on Jun. 30, 2006, the entire contents of which is incorporated herein by reference.

BACKGROUND OF THE INVENTION

1. Field of Invention

The present invention relates to a method of joining wax patterns for fabricating a golf club head, and more particularly, to a method of forming a tightly joined wax pattern from two wax patterns, with no gaps on joint surfaces.

2. Related Art

A method of directly combining two wax patterns to form a golf club head is disclosed in the specification of U.S. Pat. No. 6,739,376 of the applicant, wherein the technique of combining the two wax patterns is not further disclosed. In the specifications of U.S. Pat. No. 6,971,436, U.S. Pat. Pub. 2005/0224207, and U.S. Patent Pub. 2005/0034834, it is disclosed that resin, hot melt glue, methyl cyanoacrylate, ethyl cyanoacrylate, and other suitable adhesives and combinations thereof, are used as mediums to combine the two wax patterns, so as to melt the wax pattern to form a cavity mold after the ceramic shell has been fabricated, which is useful for the casting process. The chemical molecules of the medium are not similar to that of the wax, so the medium is easily mixed into the wax liquid after de-waxing, thereby polluting the wax liquid of the circulating system. Furthermore, because unevenness of the joint surfaces can occur due to the adhesion of wax liquid, a process of flattening by using an organic solution is also required. During this process of flattening, the organic solution may contact the element body, which can lead to destruction of the surface of the body and the original shape of the body. Still further, using the organic solution can produce air pollution which causes harm to the respiratory tract of a human operator. Furthermore, none of the wax pattern combining techniques disclosed above can make the joint surfaces of the two wax patterns form a one piece structure without any gap, and the separate flattening operation on the joint parts is additionally required, which cannot be performed during the combining process.

Therefore, a heretofore unaddressed need still exists in the art to address the aforementioned deficiencies and inadequacies.

SUMMARY OF THE INVENTION

The present invention, in one aspect, relates to a method of joining wax patterns for fabricating a golf club head. In one embodiment, the method has the steps of providing a prefabricated first wax pattern and a prefabricated second wax pattern, wherein the first wax pattern has a recess portion adapted for the second wax pattern to be embedded therein, a flange is formed on at least an edge of the recess portion, and the second wax pattern has a joining portion with a shape corresponding to that of the recess portion and a chambered receiving portion with a shape corresponding to that of the flange, for the flange to be folded over and into the chambered receiving portion. The method also has the steps of embedding the joining portion into the recess portion, heating the flange to make the flange soften, and using a flattening tool to fold the flange over and into the chambered receiving portion such that the flange and chambered receiving portion are melted into a whole, the joint surfaces of the first wax pattern and the second wax pattern are joined tightly with no gaps, and a single wax pattern is formed.

In another embodiment, the step of heating the flange to make the flange soften is performed by using the flattening tool to heat and contact the flange. The recess portion of the first wax pattern further has a step-like slot and the shape of the joining portion of the second wax pattern corresponds to that of the step-like slot. The cross-section of the flange is selected from the group having a triangle, rectangle, polygon, arc, or a combination of these. The first wax pattern is a body wax pattern and the second wax pattern is a panel wax pattern, or the first wax pattern is a panel wax pattern and the second wax pattern is a body wax pattern.

In yet another embodiment, the flattening tool is a flattening plate or a flattening rod, and the flattening tool is pre-heated to a temperature from 15° C. to 85° C., using an open type heating plate or a closed type oven.

The fabricating method of the present invention offers several significant advantages over conventional methods. One such advantage is that the method of joining the wax patterns of the present invention requires no medium to be filled between the joint surfaces of the two wax patterns, so the pure wax liquid circulating system is maintained. Furthermore, during the process of joining the two wax patterns in the present invention, the wax pattern surface of the joint surface is flattened, so as to omit an additional process for the joint surface after the joining process. Moreover, in the present invention, after finishing the joining process, the surfaces of the two wax patterns are tightly joined into a single wax pattern element, which is helpful for subsequent processes to be performed quickly.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, which thus is not limitative of the present invention, and wherein.

DETAILED DESCRIPTION OF THE INVENTION

Preferred implementing methods of the present invention are illustrated below through the embodiments with reference to the accompanying drawings in FIGS. 1-3.

Figure 1:
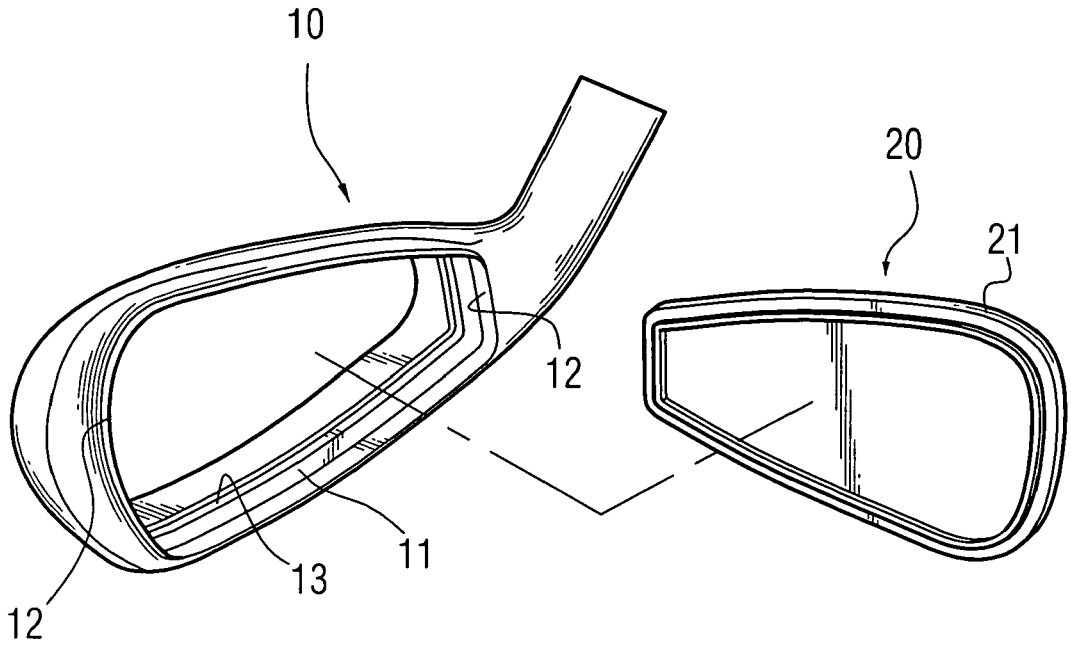
FIG. 1 is an exploded schematic stereogram of a first wax pattern and a second wax pattern according to one embodiment of the present invention.

FIG. 1 is an exploded schematic stereogram of a first wax pattern 10 and a second wax pattern 20 according to one embodiment of the present invention. The present invention may be applied for the precise casting of various golf club heads, and the golf club iron head is taken as an example in this embodiment. It is suitable for fabricating a golf club head from at least two wax patterns, such as a golf club head body wax pattern 10 and a golf club head panel wax pattern 20 that have been molded separately, by joining the two separate wax patterns 10, 20 into a single wax pattern.

Figure 2:
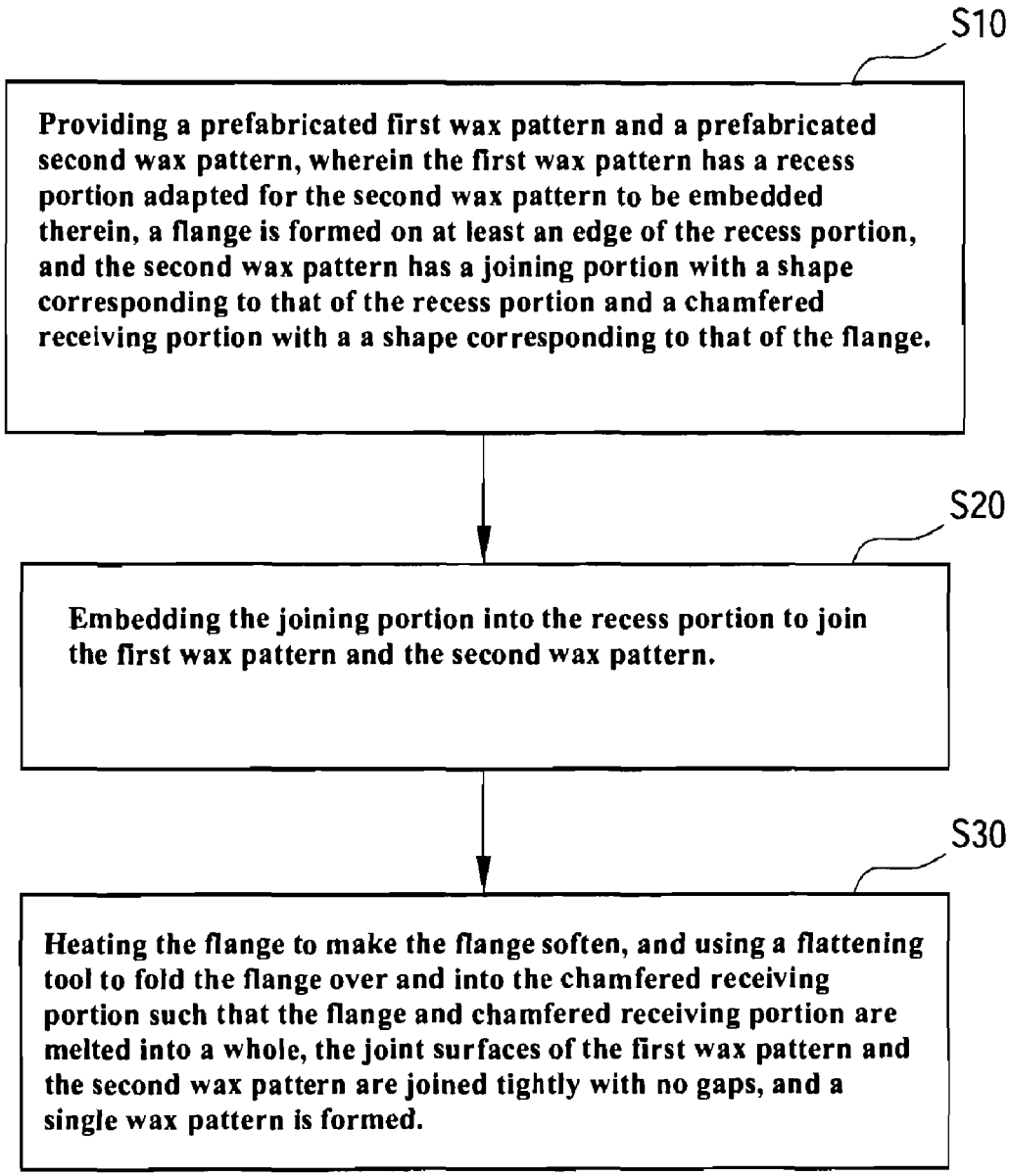
FIG. 2 is a flow chart of a method of joining wax patterns for fabricating a golf club head, according to one embodiment of the present invention.
Figure 3A:
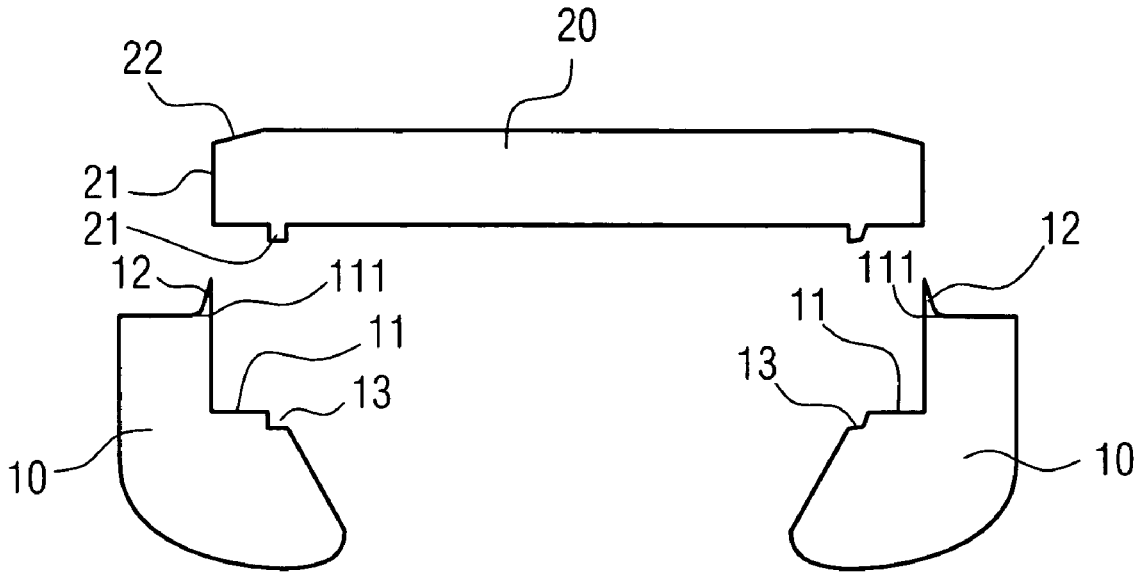
FIGS. 3A to 3D are schematic structural views that correspond to various steps of the method shown in the flow chart of FIG. 2.

FIG. 2 is a flow chart of a method of joining wax patterns for fabricating a golf club head, according to one embodiment of the present invention. At step S20 in the flow chart of FIG. 2, a prefabricated first wax pattern 10 and a prefabricated second wax pattern 20 are provided. FIG. 3A is a schematic structural view of the first wax pattern 10 and second wax pattern 20.

The first wax pattern 10 has a recess portion 11 adapted for the second wax pattern 20 to be embedded in the recess portion 11. A flange 12 is formed on an edge of the recess portion 11. The cross-section of the flange 12 may be shaped as a triangle, rectangle, polygon, arc, or a combination of these. The second wax pattern 20 has a joining portion 21 with a shape corresponding to that of the recess portion 11. A chambered receiving portion 22 is shaped to correspond to the shape of the flange 12 when the flange 12 is folded over and into the chambered receiving portion 22. Moreover, the recess portion 11 of the first wax pattern 10 has a step-like slot 13, and the shape of the joining portion 21 of the second wax pattern 20 corresponds to the shape of the step-like slot 13.

Figure 3B:
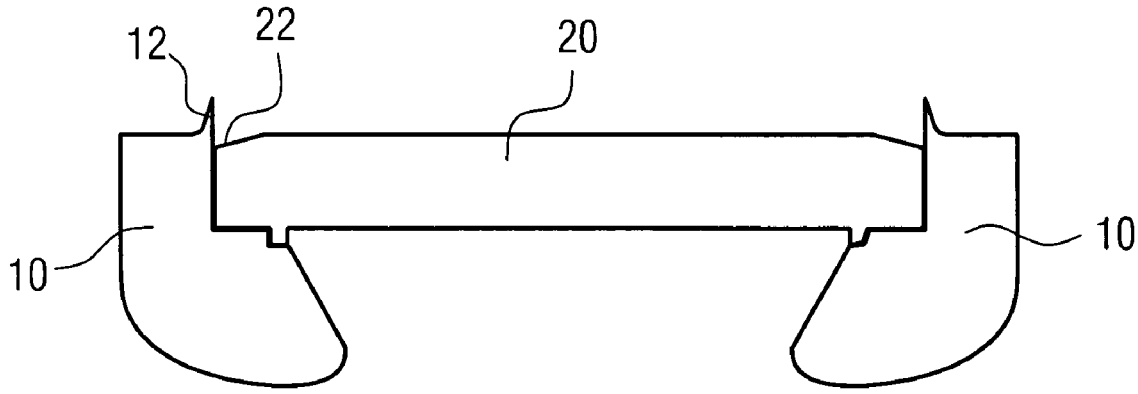

At step S20 in the flow chart of FIG. 2, the first wax pattern 10 and the second wax pattern 20 are joined. The joining portion 21 is embedded into the recess portion 11. FIG. 3B is a schematic structural view of the joined first wax pattern 10 and second wax pattern 20.

Figure 3C:
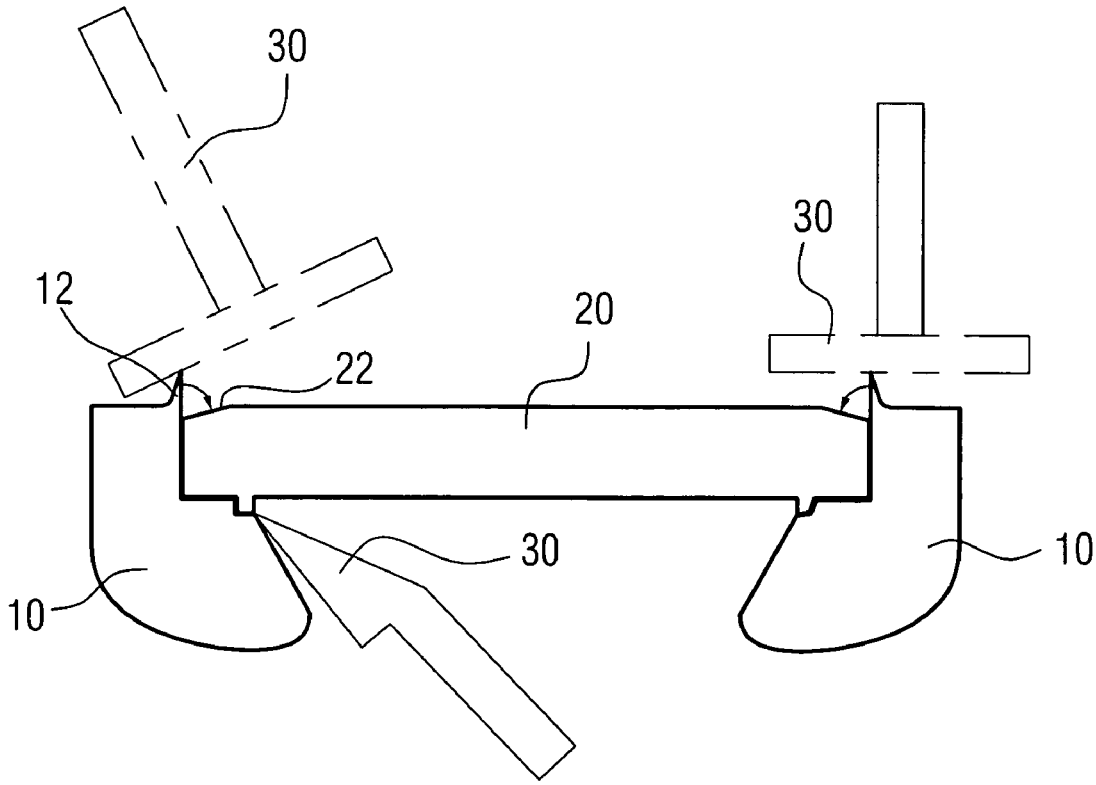
Figure 3D:
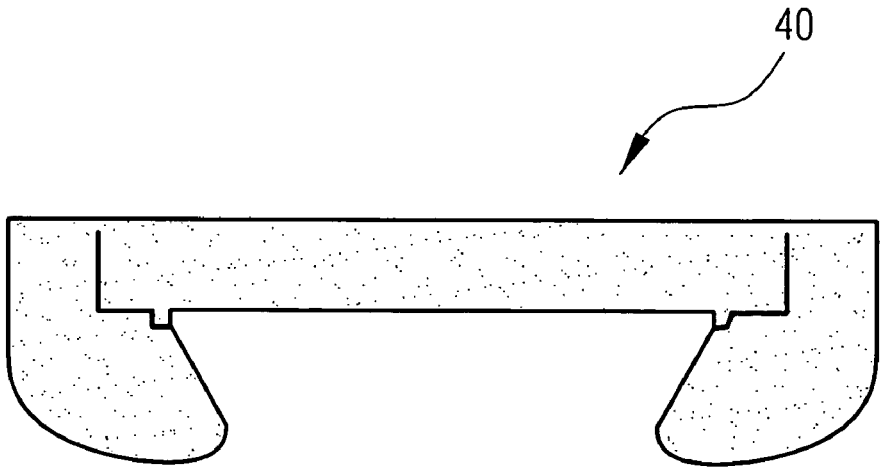

At step S30 in the flow chart of FIG. 2, the flange 12 is heated to make it soften, and the chambered receiving portion 22 is continuously heated. A flattening tool 30, which can take the form of a flattening plate or a flattening rod, is then used to fold the flange 12 over and into the chambered receiving portion 22 such that the flange 12 is melted into a whole with the chambered receiving portion 22. FIG. 3C is a schematic structural view of the flattening tool 30 being used to fold the flange 12 over and into the chambered receiving portion 22. The wax of the joint surfaces of the first wax pattern 10 and the second wax pattern 20 are mutually melted, such that the joint surfaces from the first wax pattern 10 and second wax pattern 20 are joined tightly with no gaps, and a single wax pattern is formed. FIG. 3D is a schematic structural view of the resulting single wax pattern 40.

The step of heating the flange to make it soften can be performed by using the flattening tool 30 to heat and contact the flange, and the flattening tool may be pre-heated to a temperature from 15° C. to 85° C., using an open type heating plate or a closed type oven.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of joining wax patterns for fabricating a golf club head, comprising the steps of:

providing a prefabricated first wax pattern and a prefabricated second wax pattern, wherein the first wax pattern has a recess portion adapted for the second wax pattern to be embedded therein, a flange is formed on at least an edge of the recess portion, and the second wax pattern has a joining portion with a shape corresponding to that of the recess portion and a chambered receiving portion with a shape corresponding to that of the flange;

embedding the joining portion into the recess portion;

heating the flange to make the flange soften; and using a flattening tool to fold the flange over and into the chambered receiving portion such that the flange and receiving portion are melted into a whole, the joint surfaces of the first wax pattern and the second wax pattern are joined tightly with no gaps, and a single wax pattern is formed.

2. The method of claim 1, wherein the step of heating the flange to make the flange soften is performed by using the flattening tool to heat and contact the flange.

3. The method of claim 2, wherein the flattening tool is a flattening plate or a flattening rod.

4. The method of claim 2, wherein the flattening tool is pre-heated to a temperature from 15° C. to 85° C.

5. The method of claim 2, wherein the flattening tool is pre-heated by using an open type heating plate or a close type oven.

6. The method of claim 1, wherein the recess portion of the first wax pattern further comprises a step-like slot and the shape of the joining portion of the second wax pattern further corresponds to that of the step-like slot.

7. The method of claim 1, wherein the shape of the cross-section of the flange is selected from the group consisting of a triangle, rectangle, polygon, arc and a combination thereof.

8. The method of claim 1, wherein the first wax pattern is a body wax pattern and the second wax pattern is a panel wax pattern, or the first wax pattern is a panel wax pattern and the second wax pattern is a body wax pattern.

* * * * *